US005861784A

United States Patent [19]

Heise et al.

[11] Patent Number: 5,861,784

[45] Date of Patent: Jan. 19, 1999

[54] MANUAL OVERRIDE MECHANISM FOR A REMOTE CONTROLLED CIRCUIT BREAKER

[75] Inventors: James Arthur Heise, Cedar Falls; Duane Lee Turner; Dennis William Fleege, both of Cedar Rapids, all of Iowa

[73] Assignee: Square D Company, Palatine, Ill.

[21] Appl. No.: 701,894

[22] Filed: Aug. 23, 1996

[51] Int. Cl.[6] ..... H01H 83/00

[52] U.S. Cl. ..... 335/20; 335/14; 335/16; 335/35; 335/68; 335/75; 200/400

[58] Field of Search ..... 335/20, 35, 14, 335/75, 16, 68; 200/400

[56] References Cited

U.S. PATENT DOCUMENTS

| | | | |
|---|---|---|---|
| 4,223,288 | 9/1980 | Stiner | 335/20 |
| 4,245,140 | 1/1981 | Jencks et al. | 200/153 |
| 5,180,051 | 1/1993 | Cook et al. | 200/400 |
| 5,532,660 | 7/1996 | Smith et al. | 335/14 |

*Primary Examiner*—Michael L. Gellner
*Assistant Examiner*—Tuyen T. Nguyen
*Attorney, Agent, or Firm*—Larry I. Golden; Kareem M. Irfan

[57] ABSTRACT

A remotely controllable circuit breaker device for interrupting current in a circuit path between a source and a load includes local and remote monitoring capabilities and a gear mechanism for reliable remote control of the interruption mechanism. The device includes a first contact and a second contact cooperatively arranged in the circuit path so as to provide current from the source to the load. At least one of the contacts is disposed on a contact carrier which is movable for interrupting the current provided to the load. The gear mechanism includes a motor with a rotatable shaft which responds to open and closed control signals generated from a remote location, and a gear, rotatably responsive to the rotatable shaft, for controlling the contact carrier so that the circuit path is interrupted and established, respectively. The gear mechanism controls the contact carrier using a coupling arrangement, which has a first part coupled to the contact carrier and a second part coupled to the gear. A manual override mechanism is utilized to render the coupling arrangement non-responsive to the motor. The manual override mechanism includes a manually operated member interlocked to a slide mechanism which is coupled to the gear. The slide mechanism and gear being in one position to enable the remote control mechanism to be responsive to remote control signals and in another position to disable the remote control mechanism to render it non-responsive to the remote control signals. The manually operated member is biased by a spring so that when it is released from a fixed position it pulls the slide mechanism and thusly the gear into a position where the gear no longer will move the contact carrier in response to rotation of the motor shaft.

19 Claims, 12 Drawing Sheets

MANUAL OVERRIDE MECHANISM FOR A REMOTE CONTROLLED CIRCUIT BREAKER

RELATED APPLICATIONS

The subject matter of this application is related to a circuit breaker as disclosed in U.S. patent application Ser. No. 08/701,896 entitled "Trip Flag Guide for a Circuit Breaker", U.S. patent application Ser. No. 08/703,330 entitled "Coupling Member for Securing a Spring to a Rotatable Motor Shaft" and U.S. patent application Ser. No. 08/697,383 entitled "Improved Calibration Means for a Circuit Breaker" filed on even date herewith. The above applications have the same assignee as the present invention and are incorporated herein by reference in their entirety.

FIELD OF THE INVENTION

The present invention relates generally to remote control circuit breakers and, more particularly, to improvements in the control of remotely controlled circuit breakers.

BACKGROUND OF THE INVENTION

Remote control circuit breakers are commonly used for temporary interruption of electrical service during peak use hours and for programmable lighting control of industrial locations. By opening and closing on demand from a remote location, these circuit breakers provide a significant improvement over manually operated circuit breakers in terms of convenience.

A variety of operating mechanisms have been employed to realize remote control of circuit breakers. One of the more common types of remote control mechanisms energizes a solenoid to hold the circuit breaker in the open position. Such energization must be continuous to prevent the circuit breaker from moving to the closed position.

Improved remote control mechanisms have included the use of a motor to operate the opening or closing of the contacts. The motor is coupled to one of the contacts through a gear, which rotates simultaneously with the shaft of the motor to cause the circuit breaker contacts to open and close.

Further improved remotely controlled circuit breaker mechanisms are disclosed in U.S. Pat. No. 5,180,051 entitled "Remote Controlled Circuit Breaker" and U.S. Pat. No. 5,532,660 entitled "Manual Override Mechanism for a Remote Controlled Circuit Breaker" which are assigned to the same assignee as the present application and the disclosures therein are incorporated herein by reference. The remote controlled circuit breaker disclosed in these patents includes a gear driving means responsive to OPEN and CLOSE control signals generated from a remote location for moving a moveable one of a pair of electrical contacts through associated gear means in order to correspondingly interrupt or establish a circuit path.

In all such remote controlled circuit breaker mechanisms, it is desirable to provide an override mechanism for manually controlling the circuit breaker when necessary by disabling or overriding the remote control mechanism for the circuit breaker. U.S. Pat. No. 5,532,660provides an example of such an override mechanism. However, mechanisms of this type may not operate as efficiently as necessary.

The remote control mechanism in U.S. Pat. No. 5,532,660 includes a slide mechanism which is coupled to a gear for enabling and disabling the remote control mechanism. The slide mechanism and the gear are movable between a fixed position, which renders the remote control mechanism responsive to remote control signals and a non-fixed position, which allows free movement thereof and renders the remote control mechanism non-responsive to the remote control signals.

SUMMARY OF THE INVENTION

It is a general object of the present invention to provide an improved remote control circuit breaker arrangement which is convenient to monitor and operate both locally and remotely.

It is a more specific object of the present invention to provide a remote control circuit breaker having an improved manual override mechanism for disabling the remote control mechanism when necessary.

In accordance with the present invention, the deficiency of the prior art is overcome by providing a remotely controllable circuit breaker device for interrupting current in a circuit path between a source and a load which includes local and remote monitoring capabilities and a gear mechanism for reliable control of the interruption mechanism. The device further includes a first contact and a second contact cooperatively arranged in the circuit path so as to provide current from the source to the load. At least one of the contacts is disposed on a contact carrier which is movable for interrupting the current provided to the load. The gear mechanism includes a motor with a rotatable shaft which responds to open and closed control signals generated from a remote location, and a gear, rotatably responsive to the rotatable shaft, for controlling the contact carrier so that the circuit path is interrupted and established, respectively. The gear mechanism controls the contact carrier using a coupling arrangement, which has a first part coupled to the contact carrier and a second part coupled to the gear. A manual override mechanism is utilized to render the coupling arrangement non-responsive to the motor. The manual override mechanism includes a manually operated member interlocked to a slide mechanism which is coupled to the gear. The slide mechanism and gear being in one position to enable the remote control mechanism to be responsive to remote control signals and in another position to disable the remote control mechanism to render it non-responsive to the remote control signals. The manually operated member is biased by a spring so that when it is released from a fixed position it pulls the slide mechanism and thusly the gear into a position where the gear no longer will move the contact carrier in response to rotation of the motor shaft.

BRIEF DESCRIPTION OF THE DRAWINGS

Other objects and advantages of the invention will be apparent from the following detailed description and the accompanying drawings in which.

Figure 1:
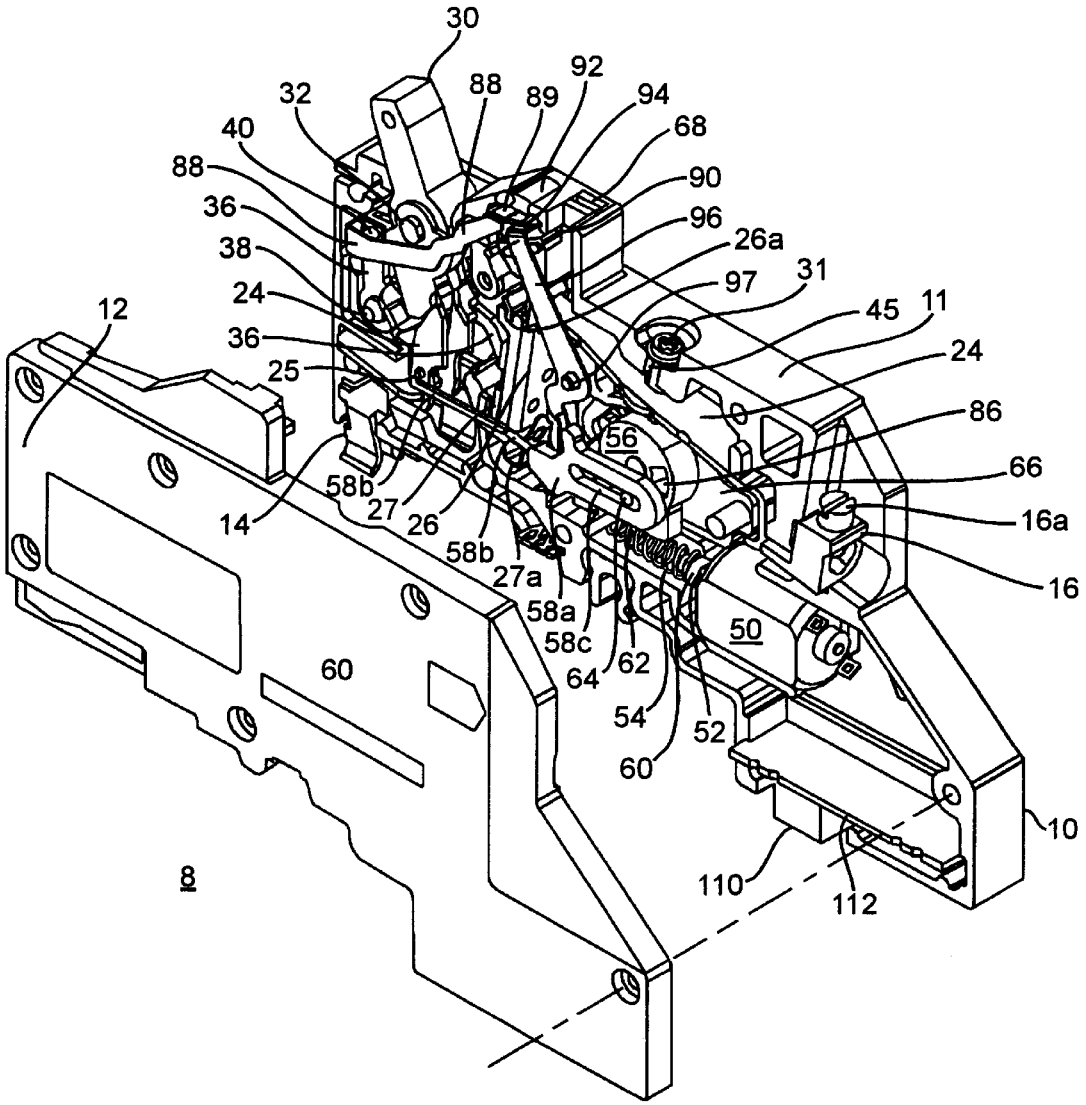
FIG. 1 is a perspective view of a remote controlled circuit breaker device according to the present invention, illustrating a housing and a cover.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the invention is to cover all modifications, equivalents, and alternatives falling within the spirit and scope of the invention as defined by the appended claims.

DETAILED DESCRIPTION OF THE PREFERRED EMBODIMENT

Turning now to the drawings and referring specifically to FIGS. 1–5, there is illustrated a remotely controllable circuit breaker device 8 according to the present invention. The circuit breaker device 8 includes an electrically insulative body or housing 10 closed at one face by a detachable cover 12, a line terminal 14 and a load terminal 16 for completing the circuit between the source and load (not shown). More specifically in FIG. 2, the circuit path beginning at the line terminal 14 carries current through stationary and movable contacts 18 and 20 and through a flexible copper conductor 22, which is attached between a contact carrier 24 and a bimetal member 28. A conductive calibration plate 29, which is attached to the bimetal member 28, carries current from the bimetal member 28 to the load terminal 16 via a second flexible copper conductor 23, which is attached between the conductive calibration plate 29 and the load terminal 16.

The above-described current path is controlled remotely and locally by a number of different components, some of which are similar in structure and operation to the corresponding components described in U.S. Pat. No. 4,623,859, entitled "Remote Control Circuit Breaker" and U.S. Pat. No. 5,245,302 entitled "Automatic Miniature Circuit Breaker With Z-Axis Assemblable Trip Mechanism" which are assigned to the same assignee as the present application and the disclosures therein are incorporated herein by reference in their entirety. For example, local control of the circuit breaker device 8 is provided using an external operating handle 30 pivotally mounted about an axis 32 in the housing 10 to control the contact carrier 24. The upper end of the contact carrier 24 is rotatably secured to the bottom of the operating handle 30 so that the contact carrier 24 can be rocked clockwise and counterclockwise using a toggle spring 34. The toggle spring 34 is secured to the bottom of the contact carrier 24 and to an equilibrium position on a trip lever 36 so as to urge the contact carrier 24 toward the handle 30. The trip lever 36 is rotatable about a pin 38 at one end and has a latching surface 36a at its other end.

In response to movement of the handle 30 to the right (OPEN position) or left (CLOSED position), the contact carrier 24 is moved counterclockwise or clockwise. respectively by the action of the toggle spring 34. The handle 30 moves the top of the contact carrier 24 to either side of the equilibrium position, so that the bottom of the contact carrier 24 biases the movable contact 20 to either the OPEN or CLOSED position.

The trip mechanism assembly includes an armature 27, an armature compensator 27*a* welded to the armature 27, the bimetal member 28 and a yoke 26. The armature 27 is pivotally supported in an armature pivot 26*a* in the yoke 26. The armature 27 includes an aperture in which a latch point 27*b* is provided to engage the latching surface 36*a* for holding or latching the trip lever 36 thereon. Upon the occurrence of a moderately sustained overload, from the CLOSED position (FIG. 2), the bimetal member 28 heats up and flexes to the right, causing the armature 27 and the yoke 26 to swing counterclockwise so as to release the stand-off pressure of the end of the trip lever 36 from the latch point 27*b*. This causes the trip lever 36 to rotate clockwise (FIG. 4) and the toggle spring 34 to pull the contact carrier 24, and the movable contact 20, away from the stationary contact 18 so as to interrupt the current path.

Figure 4:
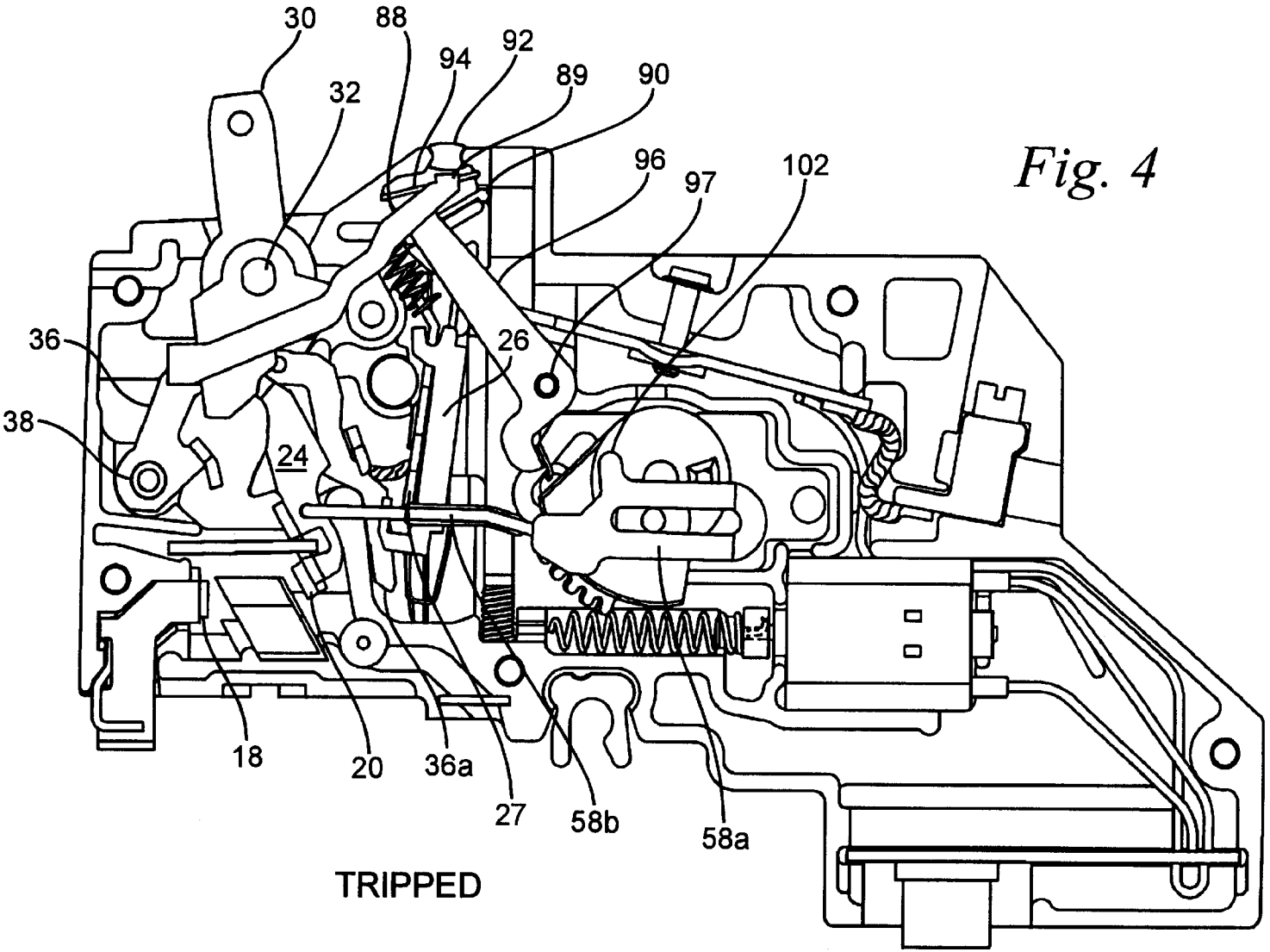
FIG. 4 is a side view of the circuit breaker of FIG. 1 with the cover removed, showing the circuit breaker in the TRIPPED position.

Similarly, upon the occurrence of an extensive current overload, the yoke 26 manifests a magnetic force that attracts the armature 27, causing it to travel counterclockwise, as shown in FIG. 4, so as to release the stand-off pressure on the latching surface 36*a* from the latch point 27*b*. This causes the trip lever 36 to rotate clockwise and the toggle spring 34 to pull the contact carrier 24 to separate the contacts 18 and 20 so that the current path is interrupted.

After being tripped as described above, the trip mechanism assembly is reset by cocking the operating handle 30 to the right so that the bottom of the operating handle 30 pushes a reset pin 40. This engagement of the reset pin 40 rotates the trip lever 36 in a counterclockwise direction to allow the latching surface 36*a* to engage the latch point 27*b*.

Figure 2:
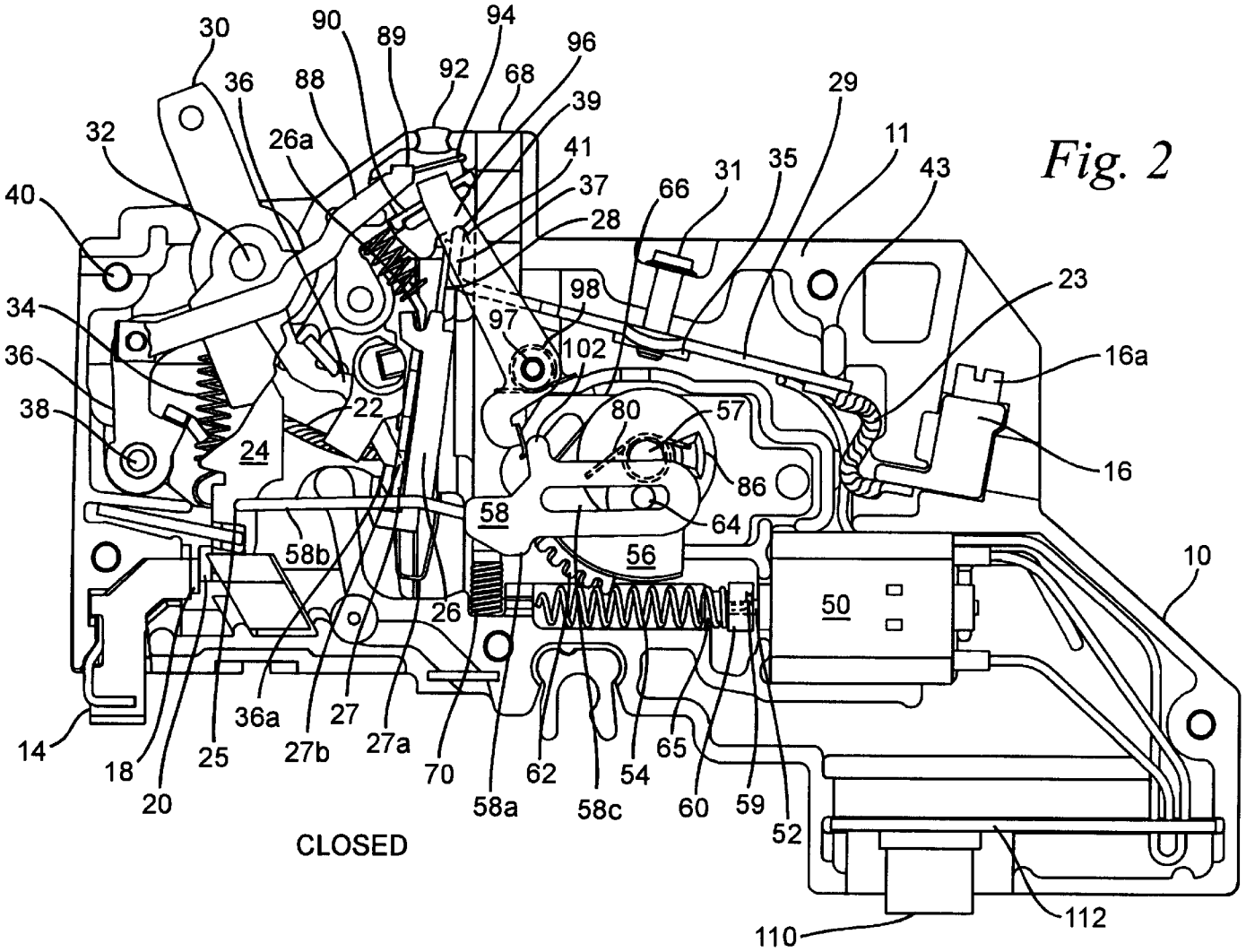
FIG. 2 is a side view of the circuit breaker of FIG. 1 with the cover removed, showing the circuit breaker in the CLOSED position.
Figure 6:
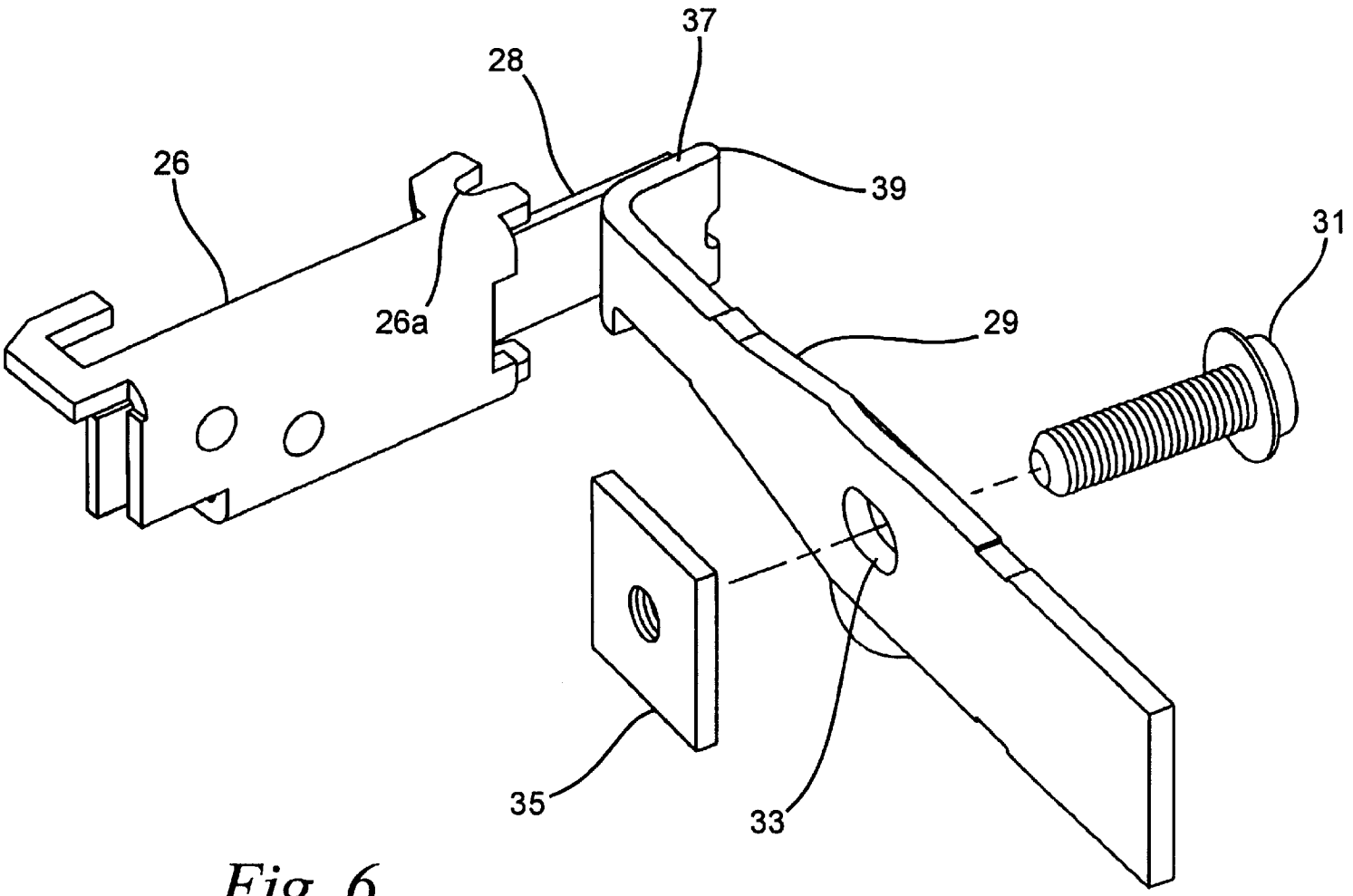
FIG. 6 is a perspective view of the preferred embodiment of a calibration assembly for use in the circuit breaker of FIG. 1.
Figure 14:
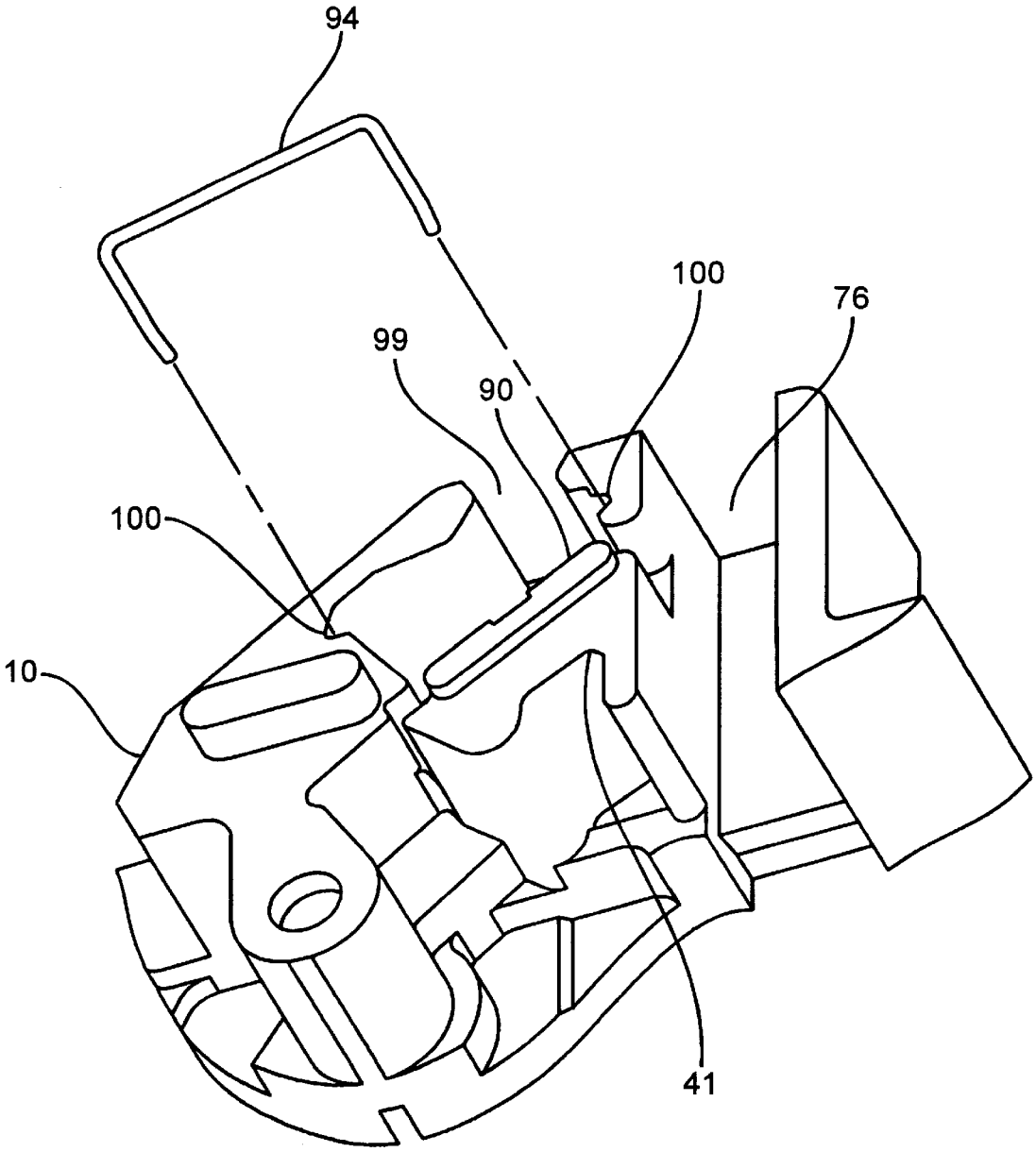
FIG. 14 is a partial exploded view of the housing for the circuit breaker of FIG. 1, according to a preferrembodiment of the present invention.

The amount of current that is required to cause the circuit breaker to trip is determined by the amount of overlap between the latching surface 36*a* and the latch point 27*b*. As shown in FIGS. 2 and 6, the preferred embodiment utilizes an improved calibration assembly to provide for increased calibration reliability in changing this overlap. The calibration assembly includes the calibration plate 29, the second flexible conductor 23, and a calibration screw 31. The calibration screw 31 extends through an aperture 45 (FIG. 1)

in a wall 11 of the housing 10 and a slotted aperture 33 in the calibration plate 29. A substantially square shaped nut 35 secures the calibration screw 31 tightly against the wall 11. The calibration plate 29 includes a leg portion 37 bent substantially perpendicular thereto which has a rounded end 39 supported in a v-block 41 (FIG. 14) formed in the housing 10. The rounded end 39 of the calibration plate provides a pivot for which the calibration plate 29 rotates thereabout. The calibration plate 29 is prevented from sliding horizontally and vertically by the v-block 41. The other end of the calibration plate 29 is supported and prevented from vertical movement by a support block 43 formed in the housing 10; however, the calibration plate 29 is allowed to slide horizontally along the support block 43. The support block 43 and the v-block 41 support the calibration plate 29 at both ends thereof; however, the middle portion of the calibration plate 29 is not supported thereby allowing it to bend into a gap between the calibration plate 29 and the housing wall 11. The slotted aperture 33 allows the calibration plate 29 to slide horizontally and bend as the calibration screw 31 is tightened into the square nut 35. The square nut 35 provides strength to the calibration plate 29 in the area of the slotted aperture 33. A lubricant is applied to the side of the square nut 35 adjacent to the calibration plate 29 to reduce the friction between the calibration plate 29 and the square nut 35. The lubricant utilized in the preferred embodiment is available as part no. 63860 from Bel-Ray Corporation of Farmingdale, N.J.

The circuit breaker device 8 is calibrated at the time it is assembled so that the amount of current that is required to cause it to interrupt the current path is pre-determined. To calibrate the circuit breaker device 8, the calibration screw 31 is tightened in order to press the calibration plate 29 against the v-block 41 and the support block 43. As the calibration screw 31 is tightened, the calibration plate 29 bends, thereby rotating the bimetal member 28 and the yoke 26 about the rounded end 39 of the calibration plate in a counterclockwise direction. As the yoke 26 rotates counterclockwise it engages the armature compensator 27*a* and forces the armature 27 to rotate counterclockwise. As the armature 27 rotates counterclockwise, the latch point 27*b* rotates away from the trip lever 36 causing a reduction in the amount of overlap between the latching surface 36*a* and the latch point 27*b*. This reduction in the overlap reduces the amount of travel required of the armature 27 before the stand-off pressure is released, thereby requiring less current to cause the trip mechanism to trip. An advantage of the second flexible conductor 23 is that a screw 16*a* in the load terminal 16 may be tightened to secure a wire therein without effecting the amount of bend in the calibration plate 29 which causes the circuit breaker device 8 to become un-calibrated. Additionally, the v-block 41 supports the rounded end 39 of the calibration plate therein thereby preventing the leg portion 37 from moving out of position and causing the amount of overlap between the latching surface 36*a* and the latch point 27*b* from changing.

Figure 7:
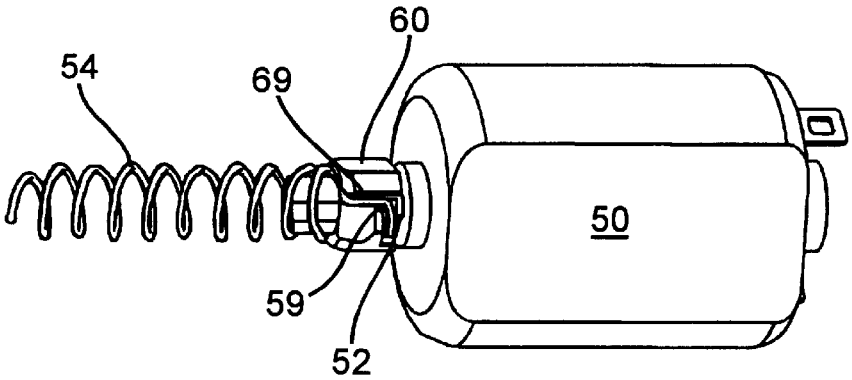
FIG. 7 is a perspective view of a motor assembly for use in the circuit breaker of FIG. 1, according to a preferred embodiment of the present invention.
Figure 8:
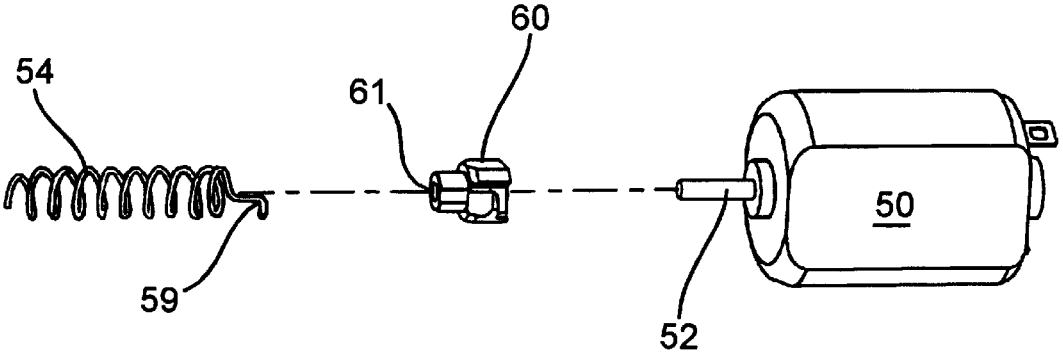
FIG. 8 is an exploded view of the motor assembly of FIG. 7, according to a preferred embodiment of the present invention.
Figure 10:
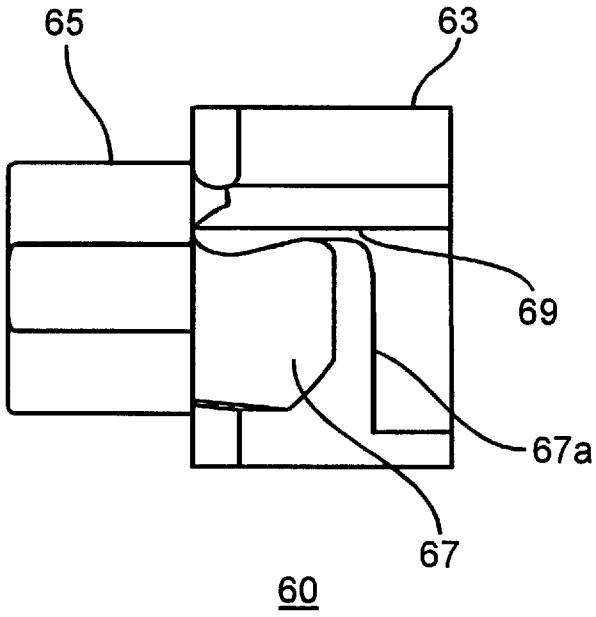
FIG. 10 is a top view of the coupler used to couple the spring to the motor shaft for the motor assembly shown in FIG. 7, according to a preferred embodiment of the present invention.
Figure 9:
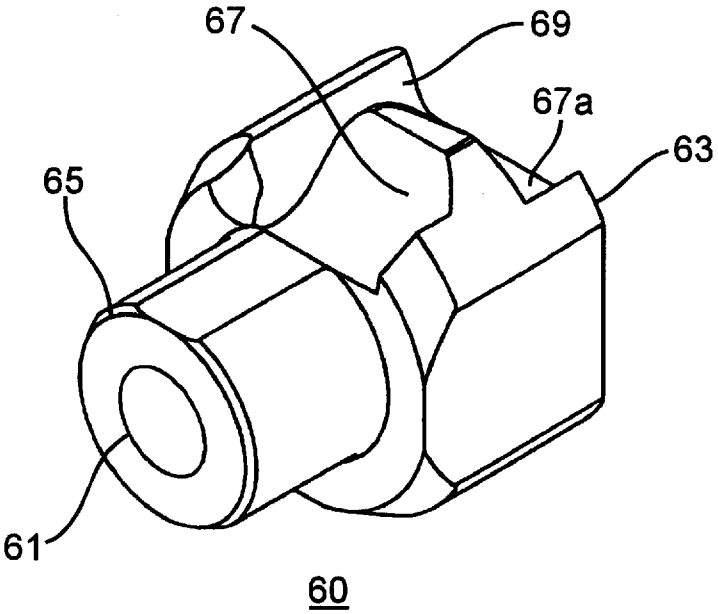
FIG. 9 is an isometric view of the preferred embodiment of a coupler used to couple a spring to a motor shaft for the motor assembly shown in FIG. 7.
Figure 12:
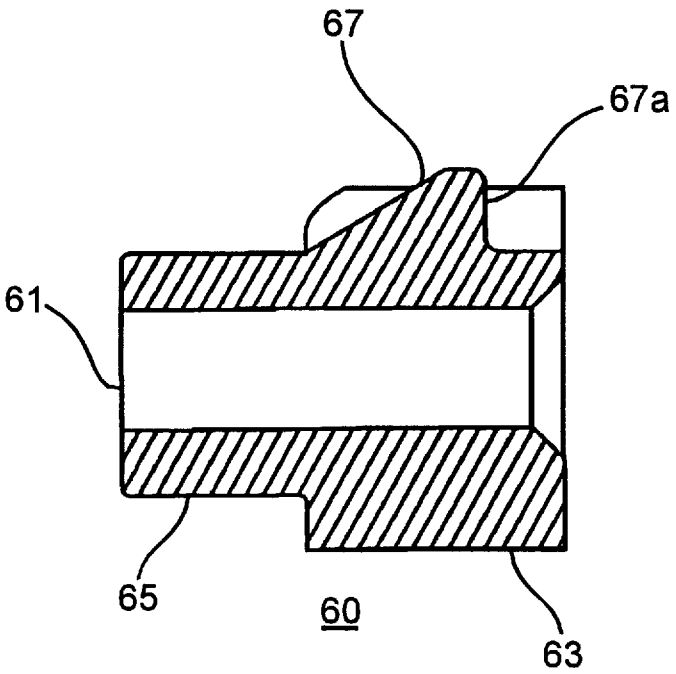
FIG. 12 is a cross-sectional view of the coupler of FIG. 11 taken along the line 12—12 of FIG. 11, according to a preferred embodiment of the present invention.
Figure 11:
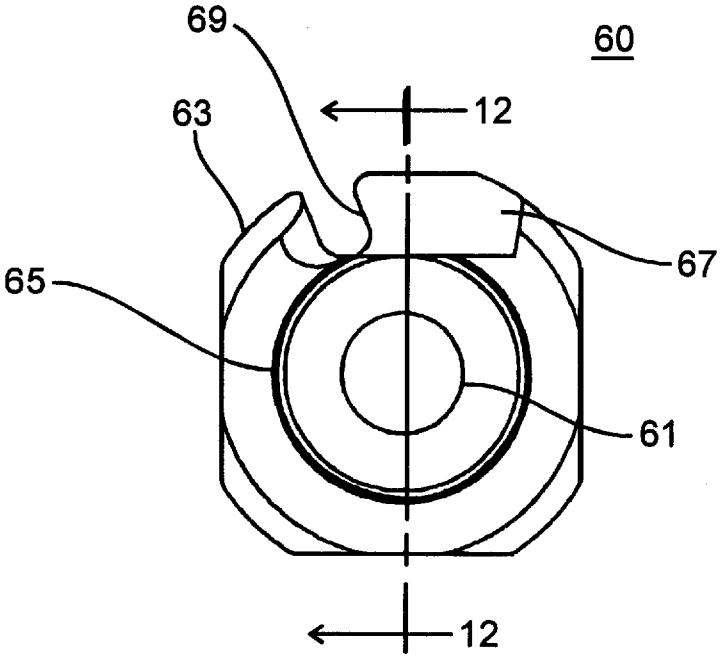
FIG. 11 is a front view of the coupler used to couple the spring to the motor shaft for the motor assembly shown in FIG. 7, according to a preferred embodiment of the present invention.

As shown in FIG. 2, remote control of the circuit breaker device 8 is provided using a motor 50 having a shaft 52 which rotates in one direction to pull the contact carrier 24 and break, or OPEN, the current path and which rotates in the opposite direction to allow the contact carrier 24 to be pulled by the toggle spring 34 to re-establish, or CLOSE, the current path. This is accomplished with a shaft spring 54 which is coupled to the shaft 52, and a gear 56 which rotates about a pin 57 to control a drive rod assembly or coupling arrangement 58. The coupling arrangement 58 includes: (i) a plate member 58*a* having a slotted aperture 58*c* defined therein for accommodating a coupling pin 64 linked to the gear 56; and (ii) a hook-shaped coupling member 58*b* having a leg portion which extends into a hole 25 in the contact carrier 24 for pulling the contact carrier 24. The shaft spring 54 is coupled to the shaft 52 via a unique coupler 60. As illustrated more clearly in FIGS. 7 and 8, the coupler 60 is pressed onto the motor shaft 52 and fits snugly thereon so that the coupler 60 rotates with the motor shaft 52 thereby causing the shaft spring 54 to rotate with the motor shaft 52. Referring back to FIG. 2, the gear 56 includes teeth 62 which interlock with the windings of the spring 54 to establish a linear relationship between the rotation of the shaft 52 and the rotation of the gear 56 about the pin 57. For example, clockwise rotation of the shaft 52 may correspond to a counterclockwise rotation of the gear 56 about the pin 57. The dimensions of the coupling arrangement 58, and more particularly, of the plate member 58*a*, aperture 58*c* and the leg portion of the hook-shaped member 58*b* are predetermined so as to provide a gap in the aperture 58*c* on the right side of the coupling pin 64 when the gear 56 is fully rotated clockwise.

The coupling pin 64, which is secured to and protrudes out of the gear 56, responds to the rotation of the gear 56 to control the position of the contact carrier 24 by virtue of being coupled thereto through the coupling arrangement 58. As the gear teeth 62 move with the shaft spring 54. the side of the gear 56 opposite the teeth 62 rotates to the same degree, thereby forcing the coupling pin 64 to rotate about the pin 57.

Figure 3:
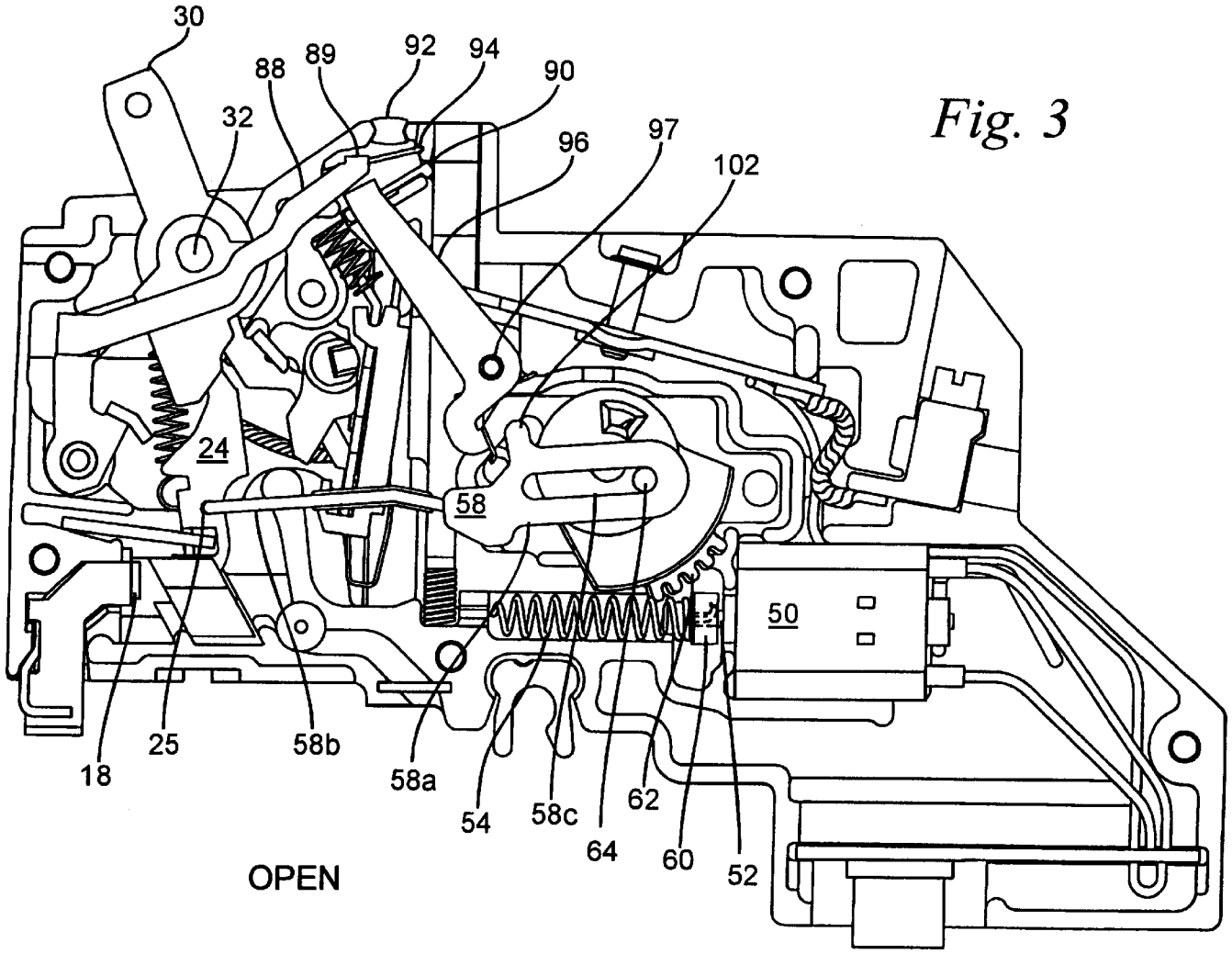
FIG. 3 is a side view of the circuit breaker of FIG. 1 with the cover removed, showing the circuit breaker in the OPEN position.

As shown in FIG. 3, the shaft spring 54 rotates in the clockwise rotation in response to the motor 50 rotating its shaft 52 in a clockwise rotation causing the gear 56 to rotate in the counterclockwise direction. As the gear 56 rotates in the counterclockwise direction, the coupling pin 64 moves towards the motor 50 and engages the end of the aperture 58*c* and continues to move towards the motor 50 thereby pulling the plate member 58*a*. As a result of pulling the plate member 58*a*, the contact carrier 24 pulls away from the stationary contact 18.

Referring once again to FIG. 2, in response to the motor 50 operating in the opposite direction (counterclockwise), the shaft 52 rotates the shaft spring 54 in the counterclockwise direction which rotates the gear 56 in the clockwise direction. As the gear rotates in the clockwise direction, the coupling pin 64 moves away from the motor 50 and separates from the end of the aperture 58*c* which then allows the toggle spring 34 to return the contact carrier 24 to the CLOSED position if the handle 30 is in the ON or CLOSED position.

As shown in FIGS. 9–12, the coupler 60 is preferably made of reinforced nylon and has a cylindrical hollow middle 61 which fits snugly onto the motor shaft 52. It is also suitable to make the coupler 60 out of any thermoplastic type of material which has good wear resistance. The coupler 60 includes a main body portion 63 and a smaller cylindrically shaped nose portion 65 extending from the body portion 63 for receiving coils of the shaft spring 54 (FIG. 2) therearound. The main body portion 63 includes a ramp portion 67 extending upwardly therefrom and a slot 69 therein for receiving a hook portion 59 (FIG. 8) extending from the shaft spring 54. During manufacture of the circuit breaker, the hook portion 59 is pushed up the ramp 67 until it snaps over the ramp portion 67 and behind a wall 67*a*. The hook portion 59 is snugly secured behind the wall 67*a* and in the slot 69 so that as the motor shaft 52 (FIG. 2) rotates, the coupler 60 causes the spring 54 (FIG. 2) to rotate.

Figure 13:
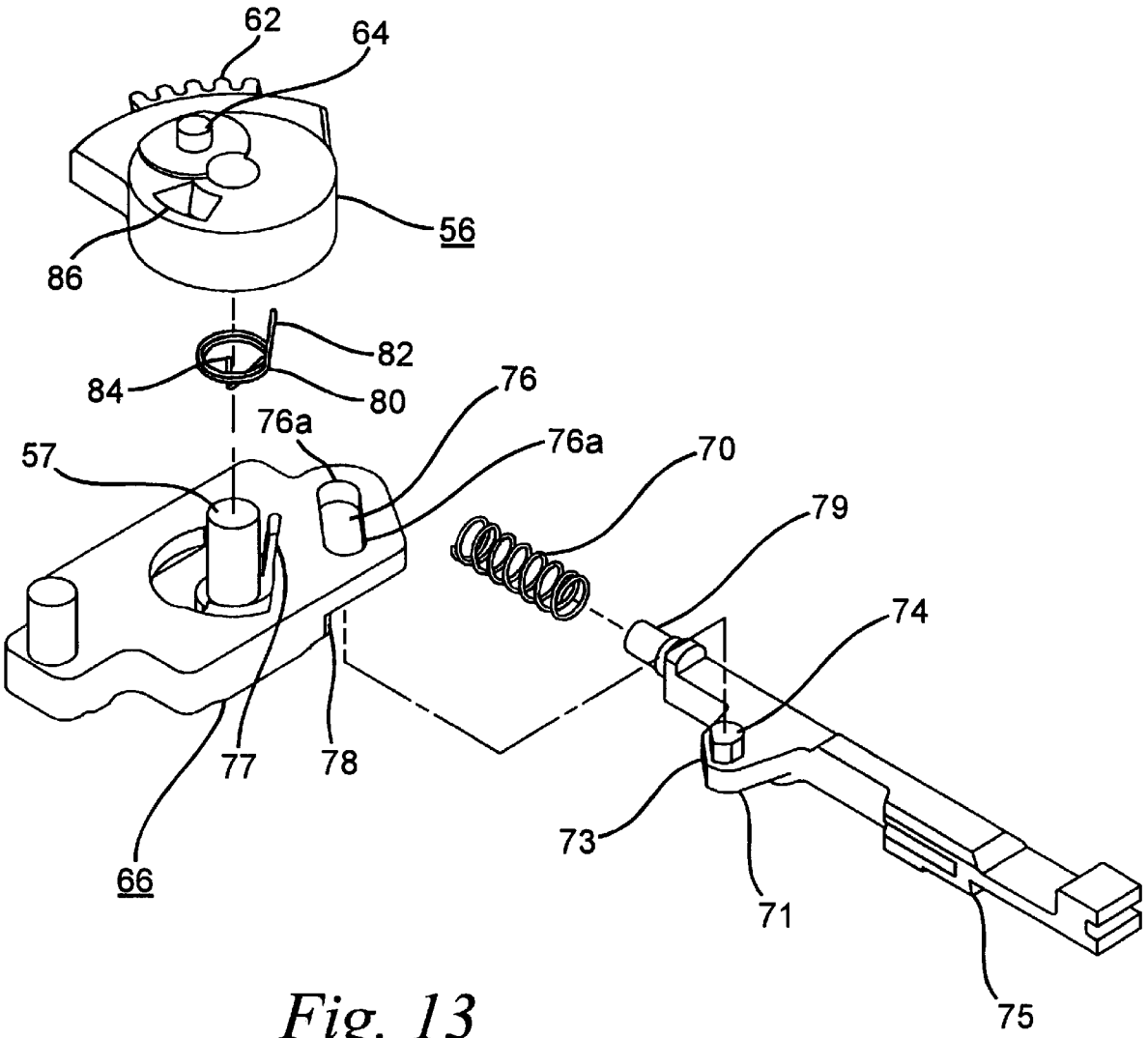
FIG. 13 is an exploded view of the override mechanism used to disable the remote control mechanism for the circuit breaker of FIG. 1, according to a preferred embodiment of the present invention.

As shown in FIGS. 2 and 13, the remote control circuit breaker device 8 described above is provided with a manual override mechanism for overriding or disabling the remote control mechanism of the circuit breaker. The override mechanism includes a slide mechanism 66, an override button 68 and a bias spring 70. The remote control mechanism is disabled when the override button 68 is released from a latched position so as to release a releasable holding force from the slide mechanism 66. More specifically, the pin 57, about which the gear 56 rotates, is defined as an integral part of the slide mechanism 66 and may be used to override or disable the remote control mechanics of the circuit breaker device 8. The releasable holding force is implemented by biasing the spring 70 between the override button 68 and a bottom portion of the housing 10.

FIG. 13 shows the override button 68 preferably has an elongated body integrally formed with a tab portion 71 extending from one side thereof and a rounded extension 79 extending from one end thereof. The tab portion 71 has a relatively flat angled edge 73 and an interlock pin 74 projecting therefrom. The override button 68 has a ridge portion 75 projecting outwardly from another side thereof. The ridge portion 75 can be configured as a shoulder portion or other releasable breaker housing engagement means for interacting with the housing to counteract the releasable holding force so the the slide mechanism is held in said responsive position thereby allowing said coupling arrangement to be responsive to the remote control signals. The slide mechanism 66 includes the pin 57, a first slot 76, a second slot 77, and an angled edge 78 adapted for engagement with the edge 73 of the override button 68. The first slot 76 accepts the interlock pin 74 therein for interlocking the slide mechanism 66 to the override button 68. Because the pin 57 is integral to the slide mechanism 66 and the gear 56 is disposed around the pin 57, the gear 56 moves integrally with the slide mechanism 66.

With the above arrangement, the releasable holding force exerted by the spring 70 urges the ridge portion 75 on the override button 68 against a corresponding obstruction, such as a notch (not shown) on the surface of the housing 10. The spring 70 is supported on one end by the elongated extension 79 and on the other end by an inside surface of the housing 10.

Figure 5:
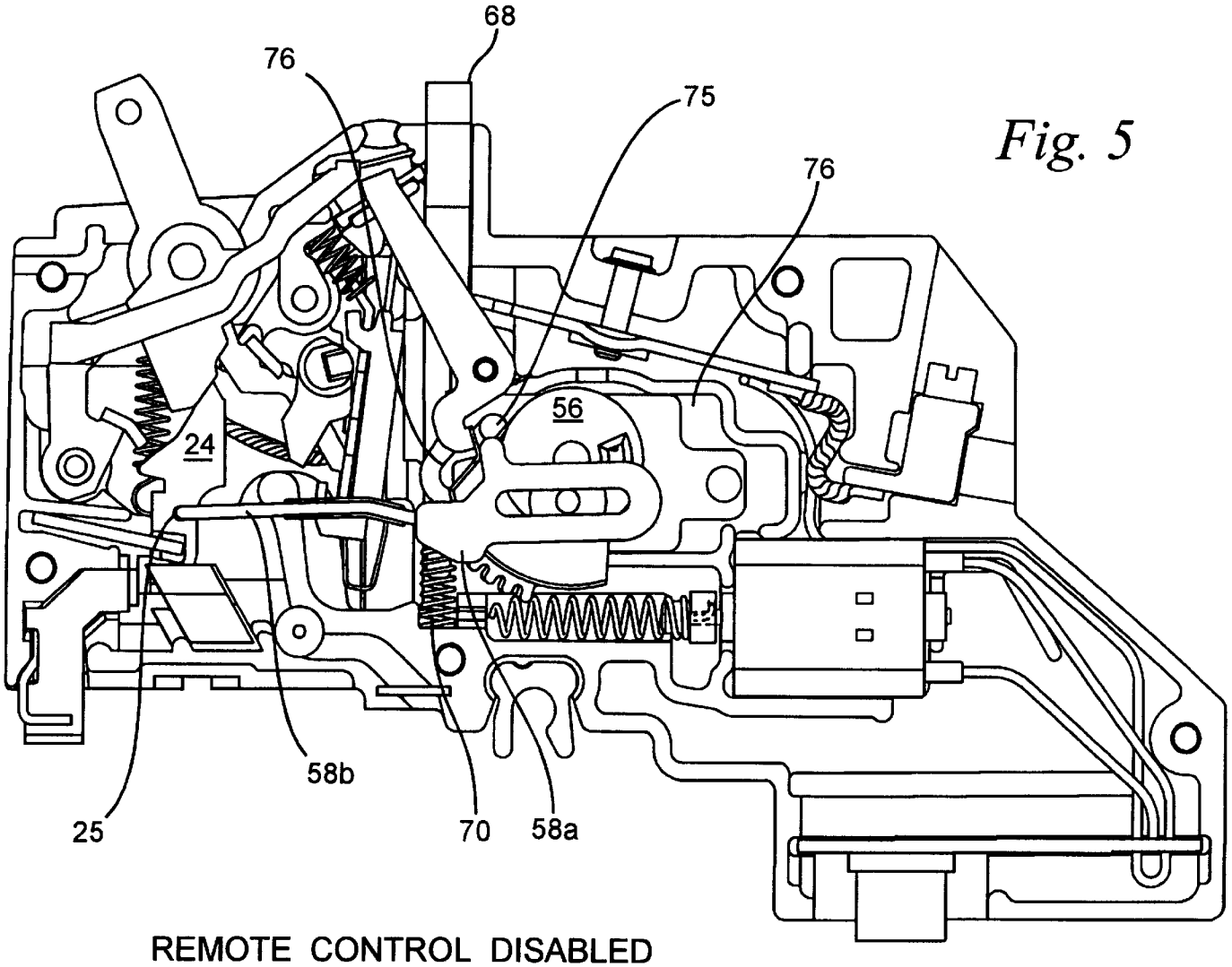
FIG. 5 is a side view of the circuit breaker with the cover removed, showing the circuit breaker with its remote control mechanism in the disabled position.

In normal remote control operation, the ridge 75 engages the notch on the housing 10, thereby holding the angled edge 73 of the override button 68 against the angled edge 78 on the slide mechanism 66. This engagement of the angled edges 73 and 78 causes the slide mechanism 66, and thusly the associated gear 56, to be in a position which allows the coupling pin 64 associated with the gear 56 to pull the contact carrier 24. Referring now to FIG. 5, the remote control operation is disabled by releasing the releasable holding force by depressing and laterally pushing the override button 68 so that the ridge 75 of the override button is removed from engagement with the notch on the housing 10. After the ridge 75 is removed from the notch, the override button 68 is released and the force of the spring 70 then pushes the override button 68 upwardly toward an aperture 76 (FIG. 14) in the housing 10 thereby moving the interlock pin 74 upwardly. This, in turn, forces the interlock pin 74 to slide in the first slot 76 from one of its ends 76*a* until it reaches an inner wall 76*b*. After the interlock pin 74 reaches the inner wall 76*b*, the bias of the spring 70 continues to pressure the interlock pin 74 upwardly and pulling the slide mechanism 66, and causing the associated gear 56, in a direction away from the motor 50. As a result, the gear 56 is no longer in a position from which the coupling pin 64 can pull the contact carrier 24. For example, the coupling pin 64 is pulled forward away from the motor 50 in the aperture 58*c*. Consequently, the pin 64 never engages the end of the aperture 58*c* and does not pull the contact carrier 24 in response to the rotation of the shaft spring 54, thereby disabling the remote control mechanism of the circuit breaker. An advantage of the preferred embodiment is that the spring 70 assists the toggle spring 34 to move the contact carrier 24 into the CLOSED position after the remote control operation is disabled if the handle 30 is in the CLOSED position. The spring 70 assists the toggle spring 34 by forcibly moving the slide mechanism 66 and the gear 56 away from the motor 50 thereby allowing the toggle spring 34 to move the contact carrier 24 into the CLOSED position.

The slide mechanism 66 is also designed to prevent disengagement of the teeth 62 from the shaft spring 54 when the remote control mechanics of the circuit breaker are not disabled and are being controlled by the motor 50. Because the shaft spring 54 can drive the gear 56 to either end of its teeth, it is conceivable that the motor 50 can overdrive the gear 56 to the extent that the shaft spring 54 is unable to maintain contact with the teeth 62. As illustrated in FIG. 13, to prevent potential disengagement, a torsion spring 80 having a first leg 82 and a second leg 84 is disposed between the slide mechanism 66 and the gear 56. The first leg 82 is disposed in the second slot 77 of the slide mechanism 66 and the second leg 84 is disposed in an aperture 86 in the gear 56. The torsion spring 80 biases the gear 56 so that at least one of the gear teeth maintains contact with the shaft spring 54 at all times. The torsion spring 86 thereby prevents gear overdrive when the gear 56 rotates in the either direction. For example, the torsion spring 86 biases the gear 56 clockwise when the gear is overdriven during counterclockwise rotation, so that the teeth 62 retain engagement with the shaft spring 54. If the gear 56 is overdriven after its counterclockwise rotation, the toggle spring 34 biases the gear 56 clockwise, by pulling the coupling pin 64 via the contact carrier 24 and the coupling member 58, so that the teeth 62 retain engagement with the shaft spring 54.

Referring once again to FIGS. 1–5, the circuit breaker device 8 described above also includes means for providing an improved contact status indication arrangement for locally indicating the status of the contacts 18 and 20. The contact status indication arrangement includes a trip flag 88, a status insert 90, a clear plastic lens 92, a flag guide 94, a status flag 96, and a status flag torsion spring 98. The trip flag 88, status insert 90 and status flag 96 are preferably colored fluorescent orange, fluorescent green and white, respectively, and are viewed through the lens 92, which is disposed in an opening 99 (FIG. 14) in the housing 10. Only one status indicator is viewable through the lens at any one time, each indicating a different circuit breaker status. For example, when the trip flag 88 is visible, the circuit breaker device 8 is in the TRIPPED position (the circuit breaker has interrupted the current flow due to a current overload); when the status insert 90 is visible, the circuit breaker is in the OFF or OPEN position (the contacts 18 and 20 are separated); and when the status flag 96 is visible, the circuit breaker is in the ON or CLOSED position (the contacts 18 and 20 are in contact with each other). Therefore, an observer can easily determine the status of the circuit breaker by looking at the front of the circuit breaker.

One end of the trip flag 88 is coupled to the trip lever 36 via the reset pin 40 and the other end has a foot extension 89 (shown best in FIG. 1) which extends outwardly therefrom in a position substantially perpendicular thereof. The foot extension 89, as seen in FIG. 1, rides on the flag guide 94 as the trip flag 88 moves forward when the circuit breaker moves into the TRIPPED position (FIG. 4). The flag guide 94 is a staple-shaped piece of wire disposed in guide slots 100 (FIG. 14) in the housing 10 and provides a reliable guide on which the trip flag 88 to travel. Furthermore, the flag guide 94 assures that the trip flag 88 is installed in the proper location during assembly of the circuit breaker. Additionally, the flag guide 94 maintains separation between the trip flag 88 and the status flag 96.

The status flag 96 rotates about a pivot pin 97 disposed in the housing 10 and has a first end thereof viewable through the lens 92 when the contacts 18 and 20 are in the CLOSED position. The other end of the status flag 96 is biased towards a knob 102 disposed on the plate 58*a* by the torsion spring 98. When the contact carrier 24 holds the movable contact 20 in engagement with the stationary contact 18, the plate 58*a* is positioned forward forcing the knob 102 into the status flag 96 and rotating it clockwise about the pivot pin 97 thereby moving the first end of the status flag 96 into a viewable position under the lens 92 to indicate that the contacts are CLOSED. When the contact carrier 24 is moved away from the stationary contact 18, the plate 58*a* is moved away from the stationary contact 18 thereby moving the knob 102 away from the status flag 96 and allowing the torsion spring 98 to rotate the status flag 96 counterclockwise into a non-viewable position (FIG. 3). The insert 90 is then viewable through the lens 90 indicating that the circuit breaker is in the OPEN position.

When the circuit breaker encounters an overcurrent condition and trips, the trip lever 36 rotates about the pin 38 in the clockwise direction causing the trip flag 88 to slide forward thereby moving the foot extension 89 of the trip flag 88 along the wire guide to a viewable position under the lens 92 to indicate that the circuit breaker has tripped. Concurrently therewith, the contact carrier 24 rotates counterclockwise causing the plate 58*a* to move towards the motor 50 thereby moving the knob 102 away from the status flag 96 and allowing the status flag 96 to rotate about the pivot pin 97 in the clockwise direction and move its first end away from the lens 92 and into a hidden position.

Most of the non-conductive components, e.g., the housing 10, the cover 12 and the operating handle 30, may be made from a thermoset-type plastic. The hook-shaped coupling member 58*b* and the springs may be manufactured using any durable metal.

Electrically, the preferred circuit breaker device 8 is operated using signals which pass through a plug-in connector 110 and a circuit board assembly 112. The plug-in connector 110 provides a conveniently removable interconnection between the circuit breaker and a remotely located control/monitoring device, while the circuit board assembly 112 carries the interface circuit for controlling the motor 50 and monitoring the current delivered to the load through load terminal 16.

Figure 15:
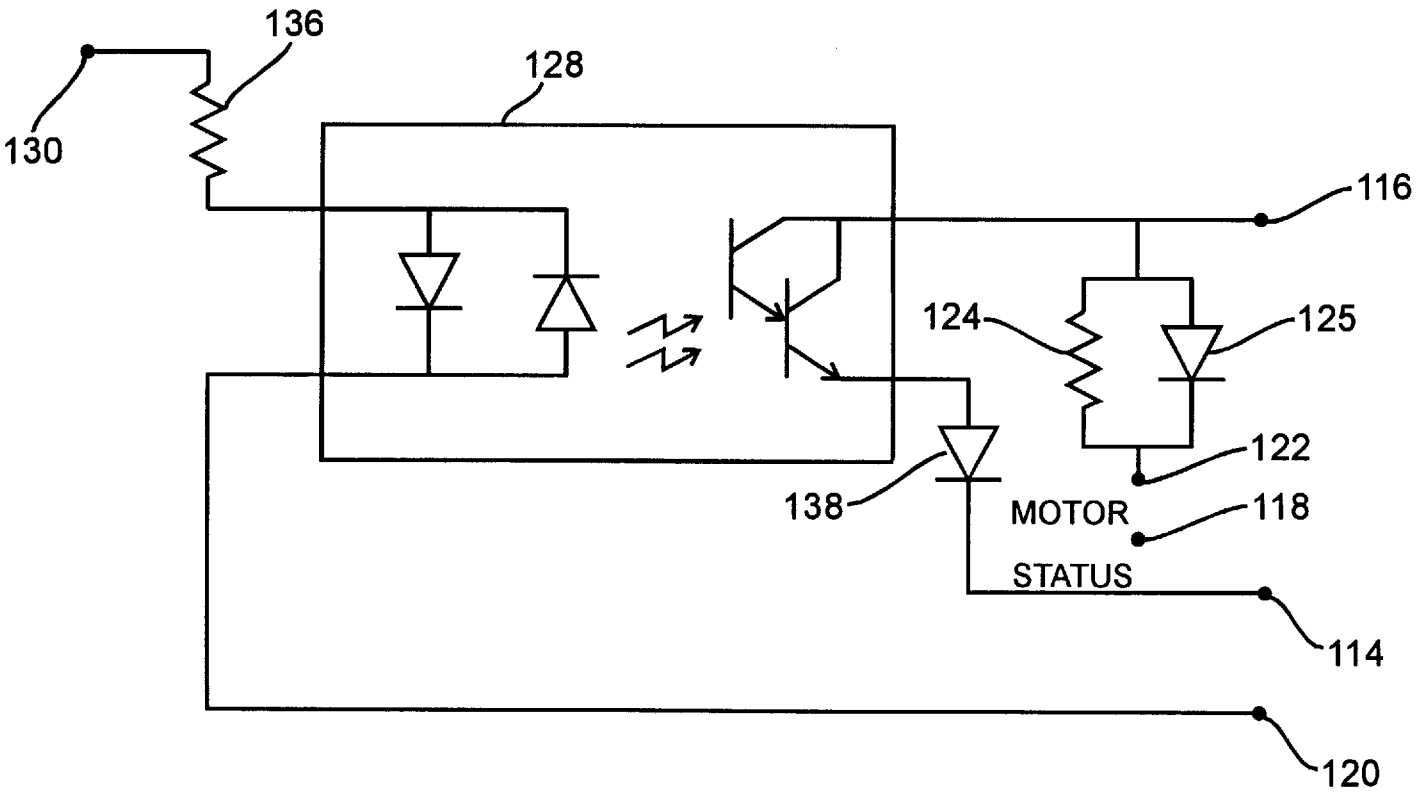
FIG. 15 is a schematic diagram of an electrical circuit which may be used to control the circuit breaker device of FIG. 1 and to monitor and report the status of the contacts.

FIG. 15 depicts a schematic diagram of the circuit on the circuit board assembly 112. There are four leads carried by the plug-in connector 110: a status lead 114, positive and negative motor leads 116 and 118, and a neutral lead 120, which is common to the circuit breaker and the device providing the remote control signaling.

The motor 50, which is preferably a FK130S-10300 Mabuchi DC motor, is directly connected to the circuit board assembly 112 at lead 118 and lead 122, with lead 116 connected to the motor 50 indirectly through a parallel resistor/diode arrangement 124/125. The parallel resistor/diode arrangement 124/125 serves two functions. The diode 125 may be used to provide current flow in a unilateral direction, while the resistor 124 is used to control the power provided from lead 116 to the motor 50.

The value of the resistor 124 is selected according to the necessary current specified to operate the motor. In the event that the lead 116 is used to control a motor, e.g., for controlling two or three circuit breaker poles, the resistance required will vary. For single pole operation by the FK130S-10300 Mabuchi motor exemplified above, the value of the resistor 124 is preferably 12 Ohms.

Forward and reverse rotation of the motor shaft 52 is then provided by applying the appropriate voltage to either lead 116 or lead 118. Provision of +24 Volts over lead 116, with respect to ground, will rotate the motor shaft 52 to cause the contact carrier 24 to separate the contacts 18 and 20, and provision of −24 Volts over lead 118, with respect to ground, will rotate the motor shaft 52 in the opposite direction to allow the contacts 18 and 20 to reconnect in the previously discussed manner.

The current that is provided to the load is remotely monitored using a sensor which is optically or magnetically coupled to the load side of the circuit breaker and communicatively coupled to the remote control/monitoring station via status lead 114 and the plug-in connector 110. The status lead 114 may be directly connected (or coupled via a radio or other non-wire interface) to the remote control signaling device to report whether or not the current path to the load has been interrupted. This is accomplished using a line isolation circuit, e.g., opto-isolator 128 (FIG. 15), having an input connected to the load terminal 16 and having an output, lead 114, connected directly to the remote control signaling device. While current is being provided to the load, current passes through current limiting resistor 136 to activate the opto-isolator 128. When activated, the opto-isolator 128 passes current through its collector-emitter output ports so as to report to the remote control/monitoring device via leads 116 and 114. When current to the load is interrupted, voltage at lead 130 is absent and the output ports of the opto-isolator 128 do not pass current; thereby indicating to the remote control/monitoring device that the contacts have interrupted the current path provided to the load. The resistor 136, preferably 180k Ohms at a ½ Watt rating, may be used at the input of the opto-isolator 128 to offset the heat dissipating through the opto-isolator 128. A diode 138 may be used to prevent reverse current from causing false contact status readings in other parts of the system, e.g., from another circuit board assembly 112 OR-tied at lead 114.

The signal which is transmitted from the remote control/monitoring device to open or close the contacts is preferably a DC pulse having a prescribed width. This pulse width is selected in accordance with a calculated and pre-measured test signal to rotate the gear 56 over a predetermined angle and, thus, move the contact carrier 24 linearly over a predetermined length so that the contacts 18 and 20 are separated or closed.

The remote control/monitoring device may then check lead 114 to determine if the circuit breaker properly responded to the transmitted contacts-open (contacts-closed) command. If the lead 114 indicates that the contacts-open (contacts-closed) command was not obeved properlyv the remote control/monitoring device may then transmit one or more additional pulses in an attempt to move the contact carrier 24 slightly further. Preferably, the remote control/monitoring device transmits up to three additional pulses, one at a time, until the lead 114 indicates that the contact carrier 24 has reacted as instructed. Preferably, the original pulse width is about 47 milliseconds to open the contacts and about 14 milliseconds to close the contacts. The pulse width of each of the follow-up pulses is equivalent to the original pulse width.

As those skilled in the art will appreciate, the present invention can be adapted and configured for use with a wide variety of circuit breakers and other circuit interrupters. The present invention is suitable for use with low, medium and high voltage applications and in various phase configurations. The term circuit breaker is defined to include but not be limited to, single or polyphase circuit breakers, vacuum or air circuit breakers, all types of circuit interrupters, fusible switches, switchgear, and the like.

The foregoing description is not limited to the specific embodiment herein described, but rather by the scope of the claims which are appended hereto. For example, although the invention has been described with reference to a single pole circuit breaker, the design may be easily adapted to a multi-pole circuit breaker or other circuit interrupters to be operated from a remote location. The term circuit breaker device as used herein includes, without limitations, any type of circuit interrupter having at least an open and closed position to control the completion of a circuit path.

What is claimed is:

1. A remotely controllable circuit breaker device for interrupting power in a circuit path between a source and a load, comprising:

a housing;

a first contact and a second contact within said housing and cooperatively arranged in the circuit path so as to provide current from the source to the load, at least one of the contacts being secured to a contact carrier which is movable for interrupting the power provided to the load;

a motor having a rotatable shaft, said motor being responsive to remote control signals generated from a remote location;

gear driving means, rotatably responsive to the rotatable shaft, for moving said contact carrier so that the circuit path may be interrupted or established, in response to the remote control signals;

a coupling arrangement, having a first part coupled to said contact carrier and a second part coupled to said gear driving means, operating in a normal mode which is responsive to said gear driving means so that the circuit path is interrupted and established in response to the remote control signals, respectively;

a slide mechanism configured to respond to remote control signal and having a slot, said slide mechanism being movable between a responsive position, which renders said coupling arrangement responsive to the remote control signals, and a non-responsive position, which renders said coupling arrangement non-responsive to the remote control signals; and an override member supported in said housing and coupled to said slide mechanism, said override member having a pin extending from said override member and received by the slot in the slide mechanism thereby coupling said slide mechanism to said override member, said override member movable between (i) a first position wherein said override member engages and activates said slide mechanism to said responsive position and (ii) a second position wherein said override member forces said slide mechanism to said non-responsive position.

2. The circuit breaker device, according to claim 1, wherein said override member further includes a first angled edge, which interacts with a corresponding second angled edge in said slide mechanism, said first and second angled edges interact to render said coupling arrangement responsive to said gear driving means.

3. The circuit breaker device, according to claim 1, wherein said slot is configured to translate the movement of the override member between said first position and said second position into movement of said slide mechanism between said responsive position and said non-responsive position.

4. The circuit breaker device, according to claim 3, wherein the movement of said override member is in the y-axis and the movement of said slide mechanism is in the x-axis.

5. The circuit breaker device, according to claim 1, wherein said slot is positioned diagonally across the x- and y-axis so that the movement of the override member in the y-axis between said first position and said second position moves said slide mechanism in the x-axis between said responsive position and said non-responsive position.

6. The circuit breaker device, according to claim 1, wherein said override member further includes an elongated member extending therefrom.

7. The circuit breaker device, according to claim 6, further including a spring extending from and surrounding said elongated member, wherein said spring provides a releasable force for holding said override member in a forced engagement with said slide mechanism, thereby holding said slide mechanism in said responsive position until the releasable force is released.

8. The circuit breaker device, according to claim 7, wherein said releasable force forces said override member to pull said slide mechanism into said non-responsive position when said releasable force is released.

9. The circuit breaker device, according to claim 7, wherein said override member further includes a ridge, which rests against an inside surface of said housing to counteract said releasable force so that said slide mechanism is held in said responsive position thereby allowing said coupling arrangement to be responsive to the remote control signals.

10. The circuit breaker device, according to claim 1, wherein said override member includes a tab portion extending outwardly therefrom, said tab portion having the pin extending upwardly and disposed in the slot in said slide mechanism for coupling said override member with said slide mechanism.

11. The circuit breaker device, according to claim 1, wherein said override member is a one piece elongated formed member.

12. A remotely controllable circuit breaker device for interrupting power in a circuit path between a source and a load, comprising:

a housing;

a first contact and a second contact cooperatively arranged in the circuit path so as to provide current from the source to the load, at least one of the contacts being secured to a contact carrier which is movable for interrupting the power provided to the load;

a motor having a rotatable shaft, said motor being responsive to remote control signals generated from a remote location;

gear driving means, rotatably responsive to the rotatable shaft, for moving said contact carrier so that the circuit path may be interrupted or established, in response to the remote control signals;

a coupling arrangement, having a first part coupled to said contact carrier and a second part coupled to said gear driving means, operating in a normal mode which is responsive to said gear driving means so that the circuit path is interrupted and established in response to the open and close remote control signals, respectively;

a slide mechanism configured to respond to remote control signal, said slide mechanism being movable between a responsive position, which renders said coupling arrangement responsive to the remote control signals, and a non-responsive position, which renders said coupling arrangement non-responsive to the remote control signals; and an override member supported in said housing and coupled to said slide mechanism, said override member movable between (i) a first position wherein said override member engages and activates said slide mechanism to said responsive position thereby rendering the coupling arrangement responsive to the remote control signals, and (ii) a second position wherein said override member forces said slide mechanism to said non-responsive position, thereby rendering the coupling arrangement non-responsive to the remote control signals, said override member having a releasable breaker housing engagement means for interacting with said housing to counteract a releasable holding force means for holding said override member in a forced engagement with said slide mechanism so that said slide mechanism is held in said responsive position thereby allowing said coupling arrangement to be responsive to the remote control signals, said override member having a ridge which rests against the inside surface of said housing to counteract said releasable force, the ridge projecting outwardly beyond one of the sides of override member near an end of the override member which extends through an aperture in said housing; and said releasable holding force means causing said override member to pull said slide mechanism when said releasable force means is released thereby placing said slide mechanism in said non-responsive position;

wherein said contact carrier does not move in response to rotation of said rotatable shaft so that the circuit path is not interrupted and established in response to the remote control signals when said slide mechanism is in said non-responsive position.

13. The circuit breaker device, according to claim 12, wherein said releasable holding force means is implemented with a spring, whereby one end of said spring surrounds an elongated member extending from said override member, and an opposite end supported by an inside surface of said housing.

14. The circuit breaker device, according to claim 12, wherein said override member further includes a first angled edge, which interacts with a corresponding second angled edge in said slide mechanism, said first and second angled edges interact to render said coupling arrangement responsive to said gear driving means.

15. The circuit breaker device, according to claim 12, wherein said releasable breaker housing engagement means is a shoulder portion integral to said override member, said releasable breaker housing engagement means is released by moving said override member laterally, thereby removing said shoulder portion from its interacting engagement with said housing.

16. The circuit breaker device, according to claim 12, wherein said override member includes a pin extending therefrom and disposed in a slot in said slide mechanism for coupling said override member with said slide mechanism.

17. A remotely controllable circuit breaker device for interrupting power in a circuit path between a source and a load, comprising:

a housing;

a first contact and a second contact cooperatively arranged in the circuit path so as to provide current from the source to the load, at least one of the contacts being secured to a contact carrier which is movable for interrupting the power provided to the load;

a motor having a rotatable shaft, said motor being responsive to remote control signals generated from a remote location;

gear driving means, rotatably responsive to the rotatable shaft, for moving said contact carrier so that the circuit path may be interrupted or established, in response to the remote control signals;

a coupling arrangement, having a first part coupled to said contact carrier and a second part coupled to said gear driving means, operating in a normal mode which is responsive to said gear driving means so that the circuit path is interrupted and established in response to the open and close remote control signals, respectively;

a slide mechanism configured to respond to remote control signal and having a slot, said slide mechanism being movable between a responsive position, which renders said coupling arrangement responsive to the remote control signals, and a non-responsive position, which renders said coupling arrangement non-responsive to the remote control signals;

an override member supported in said housing and coupled to said slide mechanism, said override member movable between (i) a first position wherein said override member engages and activates said slide mechanism to said responsive position thereby rendering the coupling arrangement responsive to the remote control signals, and (ii) a second position wherein said override member forces said slide mechanism to said non-responsive position, thereby rendering the coupling arrangement non-responsive to the remote control signals;

a pin extending from said override member disposed in the slot of said slide mechanism thereby interlocking said override member to said slide mechanism;

releasable holding force means for holding said override member in a forced engagement with said slide mechanism, thereby holding said slide mechanism in said responsive position until the releasable holding means is released, said releasable holding force means causing said override member to pull said slide mechanism when said releasable force means is released thereby placing said slide mechanism in said non-responsive position, said releasable holding force means is implemented with a spring, whereby one end of said spring surrounds an elongated member extending from said override member, and an opposite end supported in said housing;

wherein said contact carrier does not move in response to rotation of said rotatable shaft so that the circuit path is not interrupted and established in response to the remote control signals when said slide mechanism is in said non-responsive position.

18. The circuit breaker device, according to claim 17, wherein said override member further includes a first angled edge, which interacts with a corresponding second angled edge in said slide mechanism, said first and second angled edges interact to render said coupling arrangement responsive to said gear driving means.

19. The circuit breaker device, according to claim 17, wherein said override member further comprises a shoulder portion for interacting with said housing to counteract said releasable holding force means so that said slide mechanism is held in said responsive position thereby allowing said coupling arrangement to be responsive to the remote control signals, said shoulder portion is released by moving said override member inward and then laterally, thereby removing said shoulder portion from its interacting engagement with said housing.

* * * * *